US007227302B2

(12) United States Patent
Iida et al.

(10) Patent No.: US 7,227,302 B2
(45) Date of Patent: Jun. 5, 2007

(54) COLOR CATHODE-RAY TUBE

(75) Inventors: Keisuke Iida, Ibaraki (JP); Hidemi Matsuda, Toda (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/231,952

(22) Filed: Sep. 21, 2005

(65) Prior Publication Data

US 2006/0061251 A1 Mar. 23, 2006

(30) Foreign Application Priority Data

Sep. 21, 2004 (JP) ..... 2004-273737

(51) Int. Cl.
*H01J 29/10* (2006.01)

(52) U.S. Cl. ..... 313/461; 313/463; 313/466; 313/473; 313/112

(58) Field of Classification Search ..... 313/461, 313/463, 466, 473, 111, 112
See application file for complete search history.

(56) References Cited

U.S. PATENT DOCUMENTS

| | | | | |
|---|---|---|---|---|
| 4,741,962 | A | 5/1988 | Wada et al. | |
| 5,922,395 | A | 7/1999 | Koike et al. | |
| 6,100,632 | A | 8/2000 | Iida | |
| 6,590,330 | B1 * | 7/2003 | Van Doorn et al. | 313/463 |
| 6,614,160 | B1 * | 9/2003 | Lee | 313/461 |
| 6,756,727 | B2 * | 6/2004 | Bechtel et al. | 313/467 |

FOREIGN PATENT DOCUMENTS

| | | |
|---|---|---|
| JP | 63-164144 | 7/1988 |
| JP | 63-307645 | 12/1988 |
| JP | 4-66825 | 10/1992 |
| JP | 9-293463 | 11/1997 |
| JP | 10-64427 | 3/1998 |
| JP | 10-106450 | 4/1998 |
| JP | 10-302688 | 11/1998 |
| JP | 11-233018 | 8/1999 |

* cited by examiner

*Primary Examiner*—Nimeshkumar D. Patel
*Assistant Examiner*—Anthony Perry
(74) *Attorney, Agent, or Firm*—Hamre, Schumann, Mueller & Larson, P.C.

(57) ABSTRACT

Optical filter layers that transmit only light with a desired wavelength are provided in a non-formation region of an optical absorbing layer formed on an inner surface of a glass panel, and phosphor layers that emit either one of red, green, and blue light are provided on the optical filter layers. The optical filter layers transmit blue light. Assuming that the thickness of the optical filter layer underlying the phosphor layer that emits blue light is t1, and the thickness of the optical filter layers underlying the phosphor layers that emit red and green light is t2, a relationship: t1>t2 is satisfied. Because of the above configuration, a color cathode-ray tube is provided, which can be produced at low cost with satisfactory yield with less peeling of a phosphor layer.

2 Claims, 3 Drawing Sheets

COLOR CATHODE-RAY TUBE

BACKGROUND OF THE INVENTION

1. Field of the Invention

The present invention relates to a color cathode-ray tube.

2. Description of Related Art

In a phosphor screen of a current color cathode-ray tube, for the purpose of enhancing brightness and contrast, a method for providing an optical filter that transmits only light with a desired wavelength between a glass panel and a phosphor has been adopted widely (e.g., see JP 10(1998)-302668 A).

The above-mentioned phosphor screen is produced, for example, as follows. On an inner surface of a glass panel in which a light-absorbing layer such as a black matrix or a black stripe is formed, dot-shaped or stripe-shaped optical filter layers, which selectively transmit only a wavelength of red, green, or blue, are formed. Then, on the respective optical filter layers, dot-shaped or stripe-shaped phosphor layers are formed, which emit red, green, or blue light corresponding to the color of light that is transmitted through the underlying optical filter layer.

At this time, when the phosphor layers are formed directly on the optical filter layers, due to the underlying unevenness, the compatibility between an optical filter material and a phosphor material, and the like, there arises a problem of so-called "dot missing" in which a phosphor peels off the glass panel. This tendency is conspicuous particularly for green and red phosphors.

In order to solve the above-mentioned problem, a method for applying colloidal silica liquid to the optical filter layers, followed by drying, to form a silica layer, and forming phosphor layers on the silica layer has been proposed (e.g., see JP 10(1998)-64427 A and JP 11(1999)-233018 A). The method for forming such a phosphor screen will be described with reference to FIGS. 4A to 4G.

First, a light-absorbing layer (a black matrix or a black stripe) 2 is formed on an inner surface of a glass panel 12 (FIG. 4A).

Then, blue pigment dispersion liquid is applied to the inner surface of the glass panel 12 to form a blue pigment coating layer 3B (FIG. 4B).

Then, a shadow mask (not shown) is attached to the glass panel 12, and the glass panel 12 is exposed to light through the shadow mask (FIG. 4C).

Then, the shadow mask is removed, and a developer such as an alkaline aqueous solution is sprayed onto the glass panel 12 to remove the unexposed blue pigment coating layer 3B, whereby a blue pigment layer (blue filter layer) 4B is obtained (FIG. 4D).

In the same way as in the process of forming the above-mentioned blue filter layer 4B, a green filter layer 4G and a red filter layer 4R are formed (FIG. 4E).

Then, colloidal silica liquid with colloidal silica dispersed therein is applied to the optical filter layers 4B, 4G, and 4R on the inner surface of the glass panel 12, followed by drying, to form a silica layer 5 (FIG. 4F).

Then, a blue phosphor layer 6B is formed on the blue filter layer 4B, a green phosphor layer 6G is formed on the green filter layer 4G, and a red phosphor layer 6R is formed on the red filter layer 4R successively by a slurry method (FIG. 4G).

Thus, a phosphor screen 7 is provided on the inner surface of the glass panel 12.

When the thin silica layer 5 is formed on the optical filter layers 4B, 4G, and 4R as described above, the adhesion force of the phosphor layers 6B, 6G, and 6R is enhanced, which can reduce the peeling of the phosphor layers 6B, 6G, and 6R.

However, according to the above-mentioned method, the process of applying colloidal silica liquid is required, so that a material, a facility, and the like therefor are necessary, which increases cost. Furthermore, after the colloidal silica liquid is applied, excessive colloidal silica liquid splashes on the periphery and is dried to become foreign matter, which causes various kinds of defects to reduce the yield.

SUMMARY OF THE INVENTION

Therefore, with the foregoing in mind, it is an object of the present invention to provide a color cathode-ray tube that can be produced at low cost with satisfactory yield by solving the above-mentioned problems caused by applying colloidal silica liquid and providing a phosphor screen with less peeling of a phosphor layer.

A color cathode-ray tube of the present invention includes a glass panel, a light absorbing layer formed on an inner surface of the glass panel, an optical filter layer that transmits only light with a desired wavelength provided respectively in a non-formation region of the light-absorbing layer, and a phosphor layer that emits either one of red, green, and blue light provided on the optical filter layer. The optical filter layer transmits blue light. Assuming that a thickness of the optical filter layer underlying the phosphor layer that emits blue light is t1, and a thickness of the optical filter layers underlying the phosphor layers that emit red and green light is t2, a relationship: t1>t2 is satisfied.

DETAILED DESCRIPTION OF THE INVENTION

A color cathode-ray tube of the present invention includes phosphor layers with a satisfactory adhesion force without involving the process of applying colloidal silica liquid. Thus, a color cathode-ray tube that can be produced at low cost with satisfactory yield can be realized.

Figure 1:
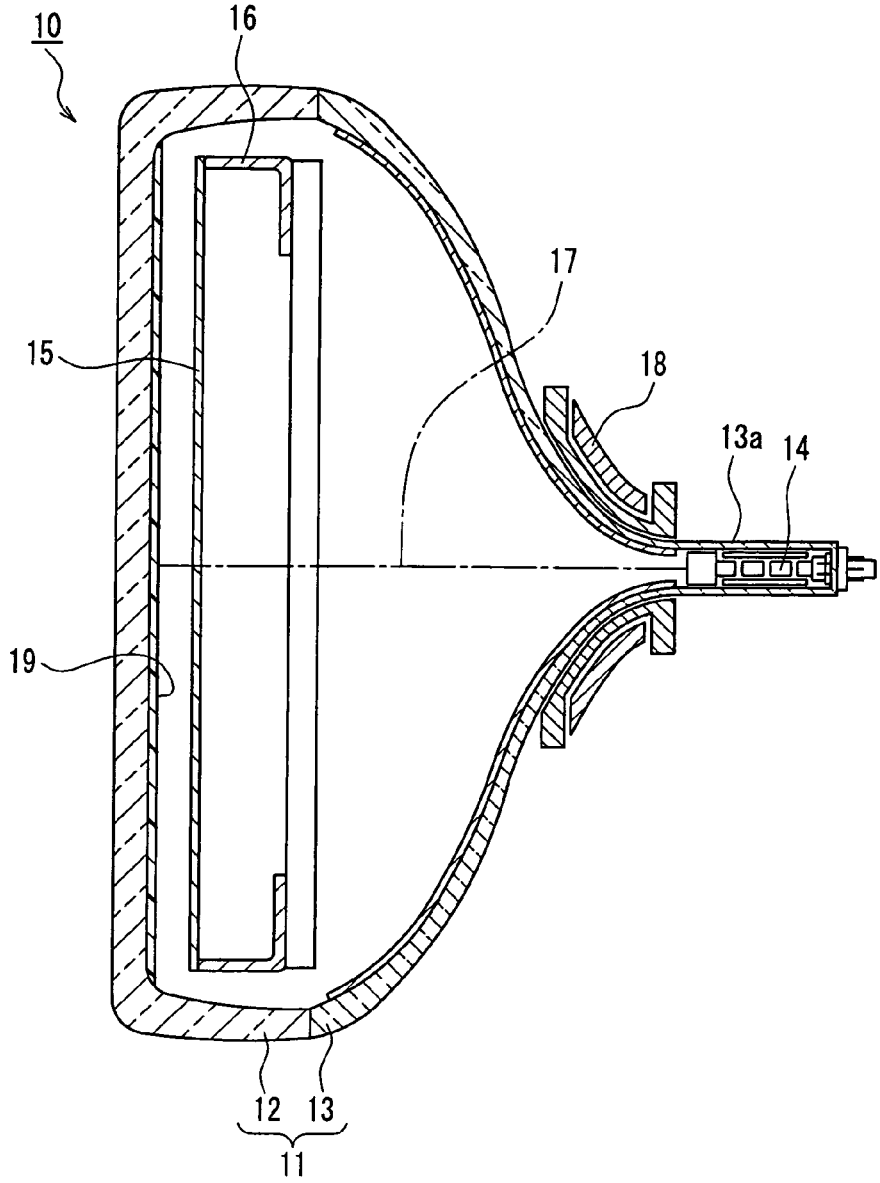
FIG. 1 is a cross-sectional view showing a schematic configuration of a color cathode-ray tube according to one embodiment of the present invention.

FIG. 1 shows one embodiment of a color cathode-ray tube of the present invention. A color cathode-ray tube 10 includes an envelope 11 composed of a glass panel 12 in which a phosphor screen 19 is formed on an inner surface, and a funnel 13. An electron gun 14 is housed in a neck 13*a* of the funnel 13. A shadow mask 15 is provided so as to be opposed to the phosphor screen 19. The shadow mask 15 is supported by a frame 16 having a substantially rectangular frame shape, and the frame 16 is attached to a panel pin (not shown) provided on an inner wall of the glass panel 12 via a spring (not shown). In order to deflect three electron beams 17 emitted from the electron gun 14 so as to allow them to scan, a deflection yoke 18 is provided on an outer circumferential surface of the funnel 13.

Figure 2:
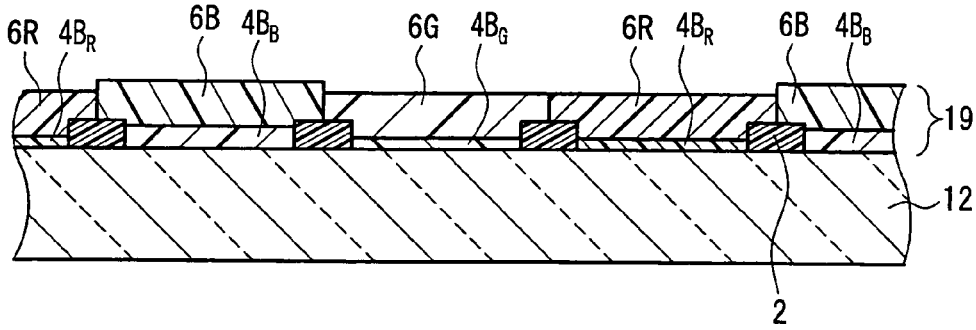
FIG. 2 is a partially enlarged cross-sectional view of a phosphor screen of the color cathode-ray tube according to one embodiment of the present invention.

FIG. 2 is a partial enlarged cross-sectional view of the phosphor screen 19. On an inner surface of the glass panel 12, a light-absorbing layer (black matrix, a black stripe, etc.) 2 is provided. In a dot-shaped or stripe-shaped non-formation region of the light-absorbing layer 2, optical filter layers $4B_B$, $4B_G$, and $4B_R$ that selectively transmit only light with a particular wavelength are provided, and phosphor layers 6B, 6G, and 6R of three colors respectively emitting red, green, or blue light are provided on the optical filter layers $4B_B$, $4B_G$, and $4B_R$. The optical filter layers $4B_B$, $4B_G$, and $4B_R$ are blue filter layers that transmit blue light. More specifically, the blue filter layers are provided as underlying layers of the green phosphor layer 6G that emits green light and the red phosphor layer 6R that emits red light, as well as an underlying layer of the blue phosphor layer 6B that emits blue light. The phosphor layers 6B, 6G, and 6R respectively are provided directly on the blue filter layers $4B_B$, $4B_G$, and $4B_R$. This enhances the adhesion force of the phosphor layers 6B, 6G, and 6R to prevent the peeling thereof even without using the conventional silica layer 5 (see FIG. 4G). Thus, the production yield is enhanced. Furthermore, the silica layer is not required, which solves the problems of the increase in cost ascribed to the increase in expenditures on a material and a facility, and the decrease in yield ascribed to the splash of colloidal silica liquid, caused by performing the process of applying colloidal silica liquid.

The compositions of the optical filter layers $4B_B$, $4B_G$, and $4B_R$ may be identical to or different from each other; however, it is preferable that the thicknesses thereof are different from each other. More specifically, assuming that the thickness of the blue filter layer $4B_B$ underlying the blue phosphor layer 6B is t1, and the thickness of the blue filter layers $4B_G$, $4B_R$ underlying the green phosphor layer 6G and the red phosphor layer 6R is t2, it is preferable that a relationship: t1>t2 is satisfied. If this condition is not satisfied, the brightness and chromaticity of green and red colors are degraded or the effect of enhancing the chromaticity of blue color is not obtained sufficiently, both of which decrease the color reproducibility of an image.

It is preferable that the thickness t1 of the blue filter layer $4B_B$ underlying the blue phosphor layer 6B satisfies the following expression:

$$1.00\ \mu m \leqq t1 \leqq 3.50\ \mu m.$$

If the thickness t1 of the blue filter layer $4B_B$ satisfies the above-mentioned numerical range, filter characteristics that are most efficient for the blue phosphor layer 6B can be obtained.

It is preferable that the thickness t2 of the blue filter layers $4B_G$, $4B_R$ underlying the green phosphor layer 6G and the red phosphor layer 6R satisfies the following expression:

$$0.01\ \mu m \leqq t2 \leqq 0.35\ \mu m$$

furthermore, $$0.05\ \mu m \leqq t2 \leqq 0.25\ \mu m.$$

When the thickness t2 of the blue filter layers $4B_G$, $4B_R$ is smaller than the above numerical range, the effect of enhancing the adhesion force of the phosphor layers 6G, 6R decreases. When the thickness t2 is larger than the above numerical range, the brightness and chromaticity of green and red colors are influenced by the blue light transmission characteristics of the blue filter layers $4B_G$, $4B_R$. The thickness of the blue filter layer $4B_G$ underlying the green phosphor layer 6G, and the thickness of the blue filter layer $4B_R$ underlying the red phosphor layer 6R may be identical to or different from each other.

Although the reason why the blue filter layer enhances the adhesion force of the phosphor layers 6B, 6G, and 6R is not clear, this is considered to be ascribed to the satisfactory compatibility between the pigment particles (e.g., cobalt aluminate ($CoO.Al_2O_3$)) contained in the blue filter layer and the phosphor particles contained in the phosphor layers 6B, 6G, and 6R

EXAMPLES

Example 1

A phosphor screen for a wide-type color cathode-ray tube with a diagonal size of 76 cm and an aspect ratio of 16:9 was produced as follows.

Figure 3A:
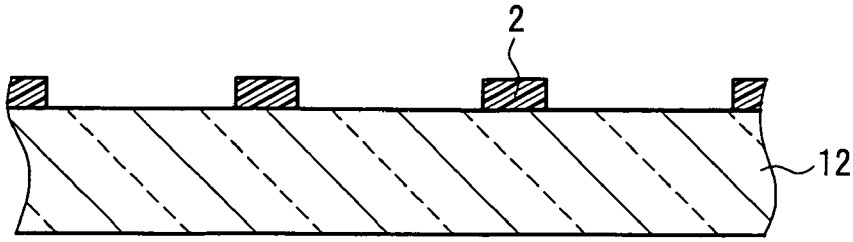
FIGS. 3A to 3E are cross-sectional views successively showing a method for forming a phosphor screen according to Example 1 of the present invention.

First, as shown in FIG. 3A, after a stripe-shaped light-absorbing layer (black matrix) 2 was formed on an inner surface of a glass panel 12 by a known method, precoating was performed. In the precoating, a precoat agent mainly containing a silane coupler was used. The silane coupler had functions of increasing the adhesion force of optical filter layers with respect to the glass panel 12 and preventing the light-absorbing layer 2 from peeling off the glass panel 12 during the formation of the optical filter layers.

Figure 3B:
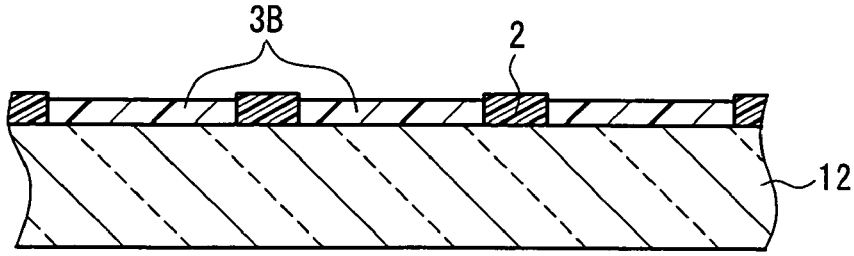

Then, as shown in FIG. 3B, a blue pigment dispersion liquid was applied to the entire inner surface of the glass panel 12, followed by drying, to form a blue pigment coating layer 3B. The blue pigment dispersion liquid contained cobalt blue ($CoO.Al_2O_3$, produced by Toyo Pigment Industry Co., Ltd.) as a blue pigment, and ammonium bichromate (ADC) and polyvinyl alcohol (PVC) as a photoresist.

Figure 3C:
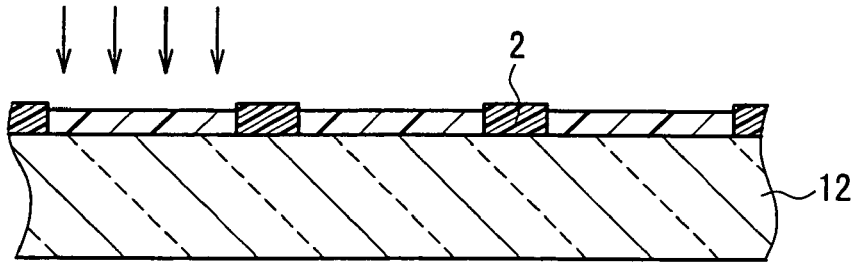

Then, as shown in FIG. 3C, a shadow mask (not shown) was attached to the glass panel 12, and only a portion where a blue phosphor layer was to be formed was exposed to light through the shadow mask.

Figure 3D:
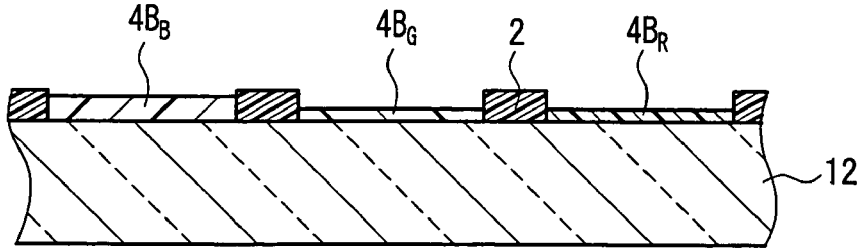

Then, the shadow mask was removed, followed by development. This development was performed under conditions weaker than those of conventional development. The weak development conditions corresponded to, for example, that a development time is shortened, the pressure of development water to be sprayed is decreased, and the alkali concentration is decreased in the case of using an alkaline aqueous solution (e.g., NaOH-containing aqueous solution) as a developer. In the present example, after the glass panel 12 was soaked in a 0.1% solution of NaOH as the developer for 20 seconds, the development was performed for 25 seconds under a pressure of 0.2 MPa of development water. Consequently, in the exposed area of a non-formation region of the light-absorbing layer 2, a blue filter layer $4B_B$ was formed, and in an unexposed area thereof, the blue pigment coating layer 3B remained to form blue filter layers $4B_G$, $4B_R$. A thickness t1 of the blue filter layer $4B_B$ was 2.1 μm, and a thickness t2 of the blue filter layers $4B_G$, $4B_r$ was 0.2 μm (FIG. 3D).

Figure 3E:
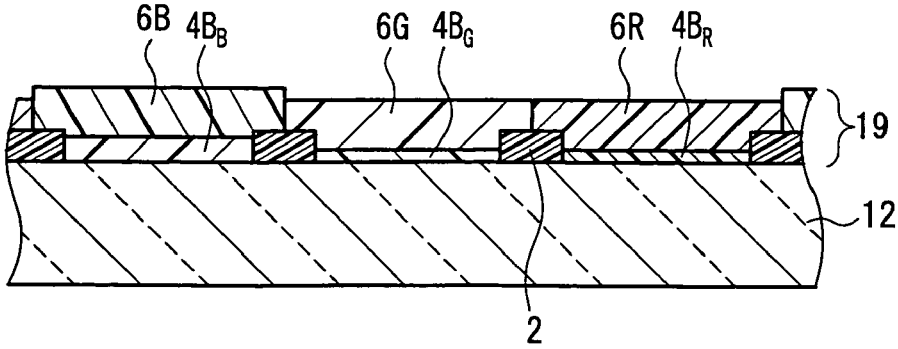

Then, a blue phosphor layer 6B was formed on the blue filter layer $4B_B$, a green phosphor layer 6G was formed on the blue filter layer $4B_G$, and a red phosphor layer 6G was formed on the blue filter layer $4B_R$ successively by a known slurry method (FIG. 3E).

Thus, a phosphor screen 19 was obtained on the inner surface of the glass panel 12.

Comparative Example 1

In Example 1, development was performed under conventionally used general development conditions to obtain a blue filter layer. More specifically, in Comparative Example 1, the glass panel 12 was soaked in a 0.3% solution of NaOH as the developer for 40 seconds, and thereafter, development was performed for 40 seconds at a pressure of 0.4 MPa of development water. The development conditions were stronger than those in Example 1. Therefore, the unexposed blue pigment coating layer 3B was substantially completely removed, and the blue filter layers 4$B_G$, 4$B_R$ were not formed.

A phosphor screen was obtained on the inner surface of the glass panel 12 in the same way as in Example 1 except for the above.

Comparative Example 2

A phosphor screen was formed by the conventional method shown in FIGS. 4A to 4G. The detail thereof is as follows.

Figure 4A:
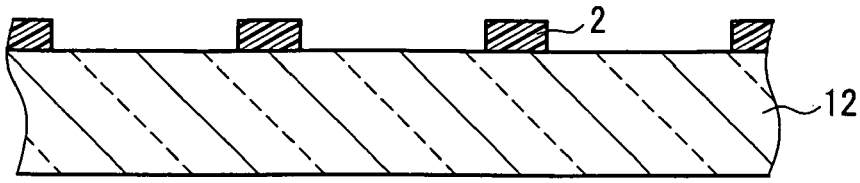
FIG. 4A PRIOR ART
FIGS. 4A to 4G are cross-sectional views successively showing a method for forming a conventional phosphor screen.

First, as shown in FIG. 4A, on an inner surface of a glass panel 12, a light-absorbing layer 2 was formed in the same way as in Example 1, and then, precoating was performed in the same way as in Example 1.

Figure 4B:
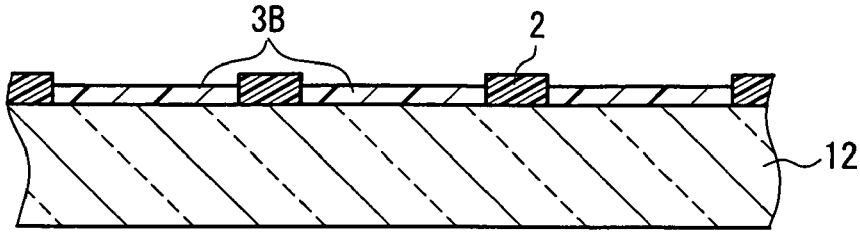
FIG. 4B PRIOR ART

Then, as shown in FIG. 4B, the same blue pigment dispersion liquid as that in Example 1 was applied to the inner surface of the glass panel 12, followed by drying, to form a blue pigment coating layer 3B.

Figure 4C:
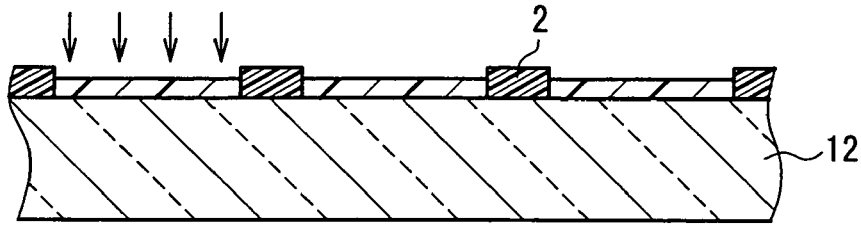
FIG. 4C PRIOR ART

Then, as shown in FIG. 4C, a shadow mask (not shown) was attached to the glass panel 12, and only a portion where a blue phosphor layer was to be formed was exposed to light through the shadow mask.

Figure 4D:
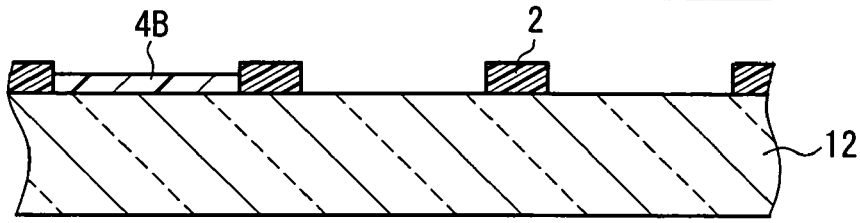
FIG. 4D PRIOR ART

Then, the shadow mask was removed, and development was performed under the same conditions as those in Comparative Example 1 to remove the unexposed blue pigment coating layer 3B, whereby a blue filter layer 4B was obtained (FIG. 4D).

Figure 4E:
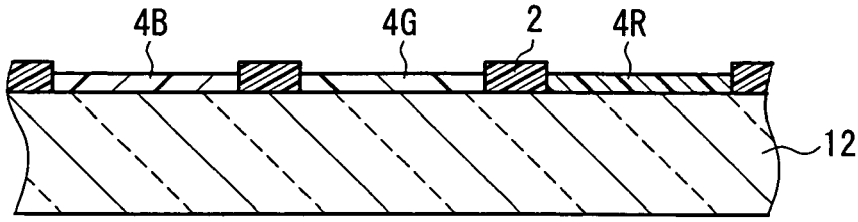
FIG. 4E PRIOR ART

A green filter layer 4G and a red filter layer 4R were formed in the same way as in the above-mentioned process of forming the blue filter layer 4B (FIG. 4E). Green pigment dispersion liquid for forming the green filter layer 4G contained cobalt green ($CoO.Cr_2O_3.TiO_2.Al_2O_3$) as a green pigment, and ammonium bichromate (ADC) and polyvinyl alcohol (PVC) as a photoresist. Red pigment dispersion liquid for forming the red filter layer 4R contained iron red ($Fe_2O_3$) as a red pigment, and ammonium bichromate (ADC) and polyvinyl alcohol (PVC) as a photoresist.

Figure 4F:
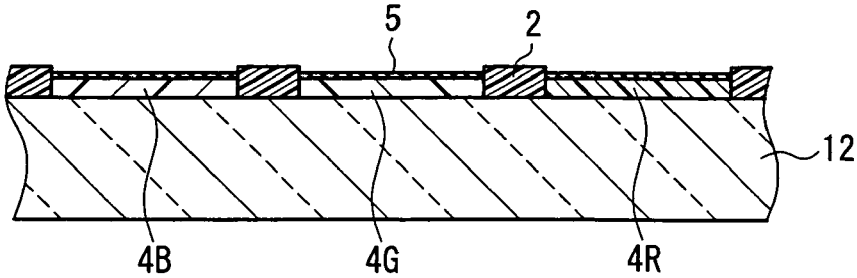
FIG. 4F PRIOR ART

Then, as shown in FIG. 4F, colloidal silica liquid with colloidal silica dispersed therein was applied to the optical filter layers 4B, 4G, and 4R on the inner surface of the glass panel 12, followed by drying, to form a silica layer 5.

Figure 4G:
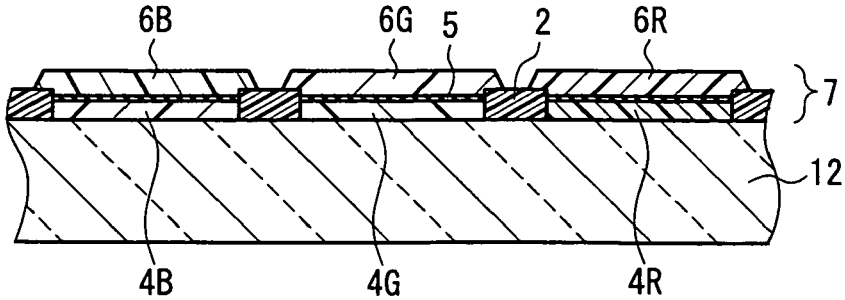
FIG. 4G PRIOR ART

Then, a blue phosphor layer 6B was formed on the blue filter layer 4B, a green phosphor layer 6G was formed on the green filter layer 4G, and a red phosphor layer 6R was formed on the red filter layer 4R successively (FIG. 4G). The materials and formation method for the blue phosphor layer 6B, the green phosphor layer 6G, and the red phosphor layer 6R were the same as those in Example 1.

Thus, a phosphor screen 7 was obtained on the inner surface of the glass panel 12.

Evaluation

One hundred samples of the glass panel 12 with a phosphor screen formed on an inner surface were produced under the respective conditions of Example 1, and Comparative Examples 1 and 2. Regarding the respective phosphor screens, the presence/absence of dot missing of the green and red phosphor layers 6G, 6R was checked. The dot missing is one of the evaluation items of a phosphor screen, and refers to a phenomenon in which a phosphor layer material in the non-formation region of the light-absorbing layer 2 peels in the course of the formation of the phosphor layers. When dot missing occurs, the color of a phosphor that has peeled at the corresponding portion is not exhibited, which degrades the color reproducibility. Table 1 shows the results.

TABLE 1

| | Number of samples | Number of green dot missing (*) | Number of red dot missing (*) | Yield ratio |
|---|---|---|---|---|
| Example 1 | 100 | 0 | 0 | 100% |
| Comparative Example 1 | 100 | 8(3) | 6(3) | 89% |
| Comparative Example 2 | 100 | 0 | 0 | 100% |

(*) The numerical value in parentheses refers to the number of the occurrences of both green dot missing and red dot missing.

As shown in Table 1, regarding the dot missing, in Example 1, the satisfactory results were obtained, which were equal to those of Comparative Example 2 in which the silica layer 5 was provided between the filter layers 4B, 4G, 4R and the phosphor layers 6B, 6G, 6R, and the results in Comparative Example 1 were inferior to the above results. This shows that, if the phosphor layers 6G, 6R respectively were formed directly on the blue filter layers 4$B_G$, 4$B_R$, the adhesion force of the phosphor layers 6G, 6R was enhanced to the same degree as that in the conventional case where the silica layer 5 was formed. Thus, according to the present invention, the silica layer 5 is not necessary, so that various problems involved in providing the silica layer 5 can be solved.

In the above Example 1, in order to obtain the blue filter layer 4$B_B$ and the blue filter layers 4$B_G$, 4$B_R$ having different thicknesses, weak development conditions were adopted. However, the present invention is not limited thereto. For example, the blue filter layer 4$B_B$ and the blue filter layers 4$B_G$, 4$B_R$ may be formed by separately applying two kinds of blue pigment dispersion liquids having different concentrations, exposing them to light, and developing them.

Comparative Example 3

In the process of light exposure in FIG. 3C in Example 1, the respective portions where the red phosphor layer and the green phosphor layer were to be formed, as well as the portion where the blue phosphor layer was to be formed, were exposed to light through the shadow mask. A phosphor screen was obtained on the inner surface of the glass panel 12 in the same way as in Example 1 except for the above. The thickness t1 of the blue filter layer 4$B_B$, and the thickness t2 of the blue filter layers 4$B_G$, 4$B_R$ were 2.1 μm.

Evaluation

Color cathode-ray tubes were produced using the glass panels 12 with a phosphor screen formed on an inner side, obtained in Example 1 and Comparative Example 3. The respective color cathode-ray tubes were operated under predetermined conditions, and the brightness of a screen center portion was measured using a CRT color analyzer "CA-100" produced by Konica Minolta Co., Ltd. (industry-standard equipment). Table 2 shows the results. In Table 2, the brightness data in Comparative Example 3 is shown as relative values with the brightness in Example 1 being 100.

TABLE 2

| | | Example 1 | Comparative Example 3 | Change ratio [%] |
|---|---|---|---|---|
| Thickness t1 [μm] | | 2.1 | 2.1 | — |
| Thickness t2 [μm] | | 0.2 | 2.1 | — |
| Brightness | Red | 100 | 63.7 | −36.3 |
| | Green | 100 | 83.9 | −16.1 |
| | Blue | 100 | 100.0 | 0.0 |

In the case where the thickness t2 of the blue filter layers 4$B_G$, 4$B_R$ was the same as the thickness t1 of the blue filter layer 4$B_B$ as in Comparative Example 3, the brightnesses of red and green were degraded remarkably.

The applicable field of the present invention is not particularly limited, and the present invention can be used in a wide range of a television receiver, a computer display, and the like The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube, comprising:

a glass panel;

a light absorbing layer formed on an inner surface of the glass panel;

an optical filter layer that transmits only light with a desired wavelength provided respectively in a non-formation region of the light-absorbing layer; and a phosphor layer that emits either one of red, green, and blue light provided on the optical filter layer, wherein the optical filter layer transmits blue light, assuming that a thickness of the optical filter layer underlying the phosphor layer that emits blue light is t1, a thickness of the optical filter layer underlying the phosphor layer that emits red light is t2r, and a thickness of the optical filter layer underlying the phosphor layer that emits green light is t2g, relationships: t1>t2r and t1>t2g are satisfied, and in each underlying layer of the phosphor layer that emits red light, the phosphor layer that emits green light, and the phosphor layer that emits blue light, only the optical filter layer that transmits blue light is provided as an optical filter layer.

2. The color cathode-ray tube according to claim 1, satisfying the following expressions:

$$1.00\ \mu m \leqq t1 \leqq 3.50\ \mu m$$

$$0.01\ \mu m \leqq t2r \leqq 0.35\ \mu m$$

$$0.01\ \mu m \leqq t2g \leqq 0.35\ \mu m.$$

* * * * *